US005773777A

United States Patent [19]

Scherer

[11] Patent Number: 5,773,777

[45] Date of Patent: Jun. 30, 1998

[54] CIRCUIT-INTERREPTING DEVICE WITH HANDLING FEATURES

[75] Inventor: Henry W. Scherer, Gurnee, Ill.

[73] Assignee: S&C Electric Company, Chicago, Ill.

[21] Appl. No.: 713,937

[22] Filed: Sep. 13, 1996

[51] Int. Cl.[6] ..... H01H 71/10; H01H 85/04

[52] U.S. Cl. ..... 218/1; 337/170; 337/171; 337/172; 337/168

[58] Field of Search ..... 218/1; 200/154, 200/144, 146, 148, 148 A; 337/168, 169, 170, 171, 172, 173, 174, 175

[56] References Cited

U.S. PATENT DOCUMENTS

| | | | |
|---|---|---|---|
| 4,321,575 | 3/1982 | Koszewa et al. | 337/168 |
| 4,414,527 | 11/1983 | Biller | 337/180 |
| 5,502,427 | 3/1996 | Scherer et al. | 337/176 |
| 5,532,668 | 7/1996 | Fennell | 337/168 |

*Primary Examiner*—Peter S. Wong
*Assistant Examiner*—Rajnikant B. Patel
*Attorney, Agent, or Firm*—James V. Lapacek

[57] ABSTRACT

A circuit-interrupting device for electrical power distribution and transmission systems is provided having improved handling provisions for removal and installation with respect to conventional mountings. The handling provisions permit the circuit-interrupting device to pivot about the lower hinge of the mounting before the circuit-interrupting device is lifted out of the mounting via a handling tool. This permits the dimensions of the circuit-interrupting device to be greater than conventional circuit-interrupting devices. For example, in a preferred embodiment, the circuit-interrupting device includes exhaust diverter structure which directs exhaust away from the mounting, the exhaust diverter structure extending beyond the maximum dimensions which allow the circuit-interrupting device to be directly lifted out of the mounting hinge, i.e. the exhaust diverter structure interferes with the mounting if the circuit-interrupting device is lifted in a direction out of the mounting. The handling provisions include a handling loop on the circuit-interrupting device that is spaced away from the trunnion of the circuit-interrupting device which is received by the lower hinge of the mounting. The location of the handling loop is selected so as to provide suitable pivoting of the circuit-interrupting device before lifting out of the mounting hinge.

10 Claims, 2 Drawing Sheets

CIRCUIT-INTERREPTING DEVICE WITH HANDLING FEATURES

BACKGROUND OF THE INVENTION

1. Field of the Invention

The present invention relates generally to the field of circuit-interrupting devices and more particularly to a circuit-interrupting device with improved handling features regarding insertion and removal with respect to a mounting.

2. Description of the Related Art

Many types of circuit interrupting devices in the electrical power distribution and transmission field are installed in mountings so as to be selectively removable from the mountings. For example, one popular device is a conventional fuse cutout, one form of which is shown in U.S. Pat. No. 4,414,527. Another popular device is the SMD-20® power fuse available from the S&C Electric Company, Chicago, Ill. Another device, known as a fuse limiter, is shown in U.S. Pat. No. 5,502,427.

Various handling tools are used to manipulate cutouts, fuses and other similar devices. Specifically, the handling tool is used to remove or insert a device from its mounting. Typically, these devices are hingedly carried with respect to their respective mountings and many also move to a drop-out position after the device has operated to interrupt the circuit. The devices typically include one or more structural features or fittings that are designed for cooperation with corresponding features of the handling tools which include fingers, prongs, clamps or cradles. For example, one typical handling feature of a device is a pull ring (see reference number 54 of FIG. 3 of U.S. Pat. No. 4,414,527). Via the manipulation of a prong or finger of a handling tool that is inserted through an aperture of the pull ring, a fuse tube of a cutout may be pivoted between opened and closed positions with respect to the cutout mounting. Additionally, conventional fuse tubes for fuse and cutout mountings typically include provisions at their lower fittings such as a loop or band for the passage of a prong (which is dimensioned per ANSI Standards) to aid in the removal and insertion of the fuse tube with respect to the mounting. To insert the fuse tube into its mounting, a specific portion or prong of the handling tool is inserted through the loop or band of the lower fitting of the fuse tube and the device is lifted via the pole of the handling tool to the vicinity of the overhead mounting and appropriately placed therein. Removal is effected by reversing the insertion process, i.e. with the device in the open position, a prong of the handling tool is inserted through the loop and the device is lifted out of the mounting and lowered to the operator. In many circumstances, this operation can require both strength and dexterity since the mounting can be located as much as 30 feet above the operator. Further, even relatively moderate wind conditions cause additional difficulty. While a certain degree of skill and strength is necessitated merely by the weight of the fuse tube at the end of the pole and the need for accurate placement in the mounting, the design and orientation of the handling tool also affects the handling and operation as well as the force experienced by the operator. In the case of many available handling tools, the task is exacerbated and the operator experiences additional forces on the pole as the operator is required to change the orientation of the pole and handling tool to perform the task. One specific type of handling tool, the Talon™, Catalog No. 4440, available from S&C Electric Company, Chicago, Ill., 60626, is especially useful for and suited to manipulation of the fuse limiter of the aforementioned U.S. Pat. No. 5,502,427. U.S. Pat. No. 5,532,668 summarizes the difficulties that can be encountered when handling various fuse and cutout devices with ordinary handling tools. This patent is directed to trunnion arrangements and adapters to improve the stability of handling through the provision of elongated slots with which a hot stick may be used with a lessened chance of being displaced from the slot on the device during handling. In one arrangement (FIG. 8 of U.S. Pat. No. 5,532,668), a safety slot member 71 is attached (preferably slidably) to a fuse tube such that the safety member slides up the to engage the trunnion and prevent rotation of the about the hinge pivots, the safety slot member also providing an elongated slot which is stated to improve stability of handling.

In view of the foregoing, while the devices and handling tools of the prior art may be generally suitable for their intended uses, the geometry of the device is limited by the mountings in that the device in the open position must be capable of being lifted out of the mounting without interference.

SUMMARY OF THE INVENTION

Accordingly, it is a principal object of the present invention to provide improved exhaust control features for circuit-interrupting devices that can be accommodated within conventional mountings.

It is another object of the present invention to provide a circuit-interrupting device with exhaust diverting structure that extends beyond the typical dimensions that can be accommodated by a conventional cutout mounting.

It is a further object of the present invention to provide an improved circuit-interrupting device with handling provisions that permit insertion and removal of the circuit-interrupting device with respect to a conventional cutout mounting although the dimensions of the circuit-interrupting device are such that it can not be removed from the mounting by lifting at the trunnion of the circuit-interrupting device.

It is yet another object of the present invention to provide improved handling provisions for circuit-interrupting devices so as to permit larger circuit-interrupting devices to be accommodated within conventional mountings.

These and other objects of the present invention are efficiently achieved by a circuit-interrupting device for electrical power distribution and transmission systems with improved handling provisions for removal and installation with respect to conventional mountings. The handling provisions permit the circuit-interrupting device to pivot about the lower hinge of the mounting before the circuit-interrupting device is lifted out of the mounting via a handling tool. This permits the dimensions of the circuit-interrupting device to be greater than conventional circuit-interrupting devices. For example, in a preferred embodiment, the circuit-interrupting device includes exhaust diverter structure which directs exhaust away from the mounting, the exhaust diverter structure extending beyond the maximum dimensions which allow the circuit-interrupting device to be directly lifted out of the mounting hinge, i.e. the exhaust diverter structure interferes with the mounting if the circuit-interrupting device is lifted in a direction out of the mounting. The handling provisions include a handling loop on the circuit-interrupting device that is spaced away from the trunnion of the circuit-interrupting device which is received by the lower hinge of the mounting. The location of the handling loop is selected so as to provide suitable pivoting of the circuit-interrupting device before lifting out of the mounting hinge.

BRIEF DESCRIPTION OF THE DRAWING

The invention, both as to its organization and method of operation, together with further objects and advantages thereof, will best be understood by reference to the specification taken in conjunction with the accompanying drawing in which.

DETAILED DESCRIPTION

Figure 1:
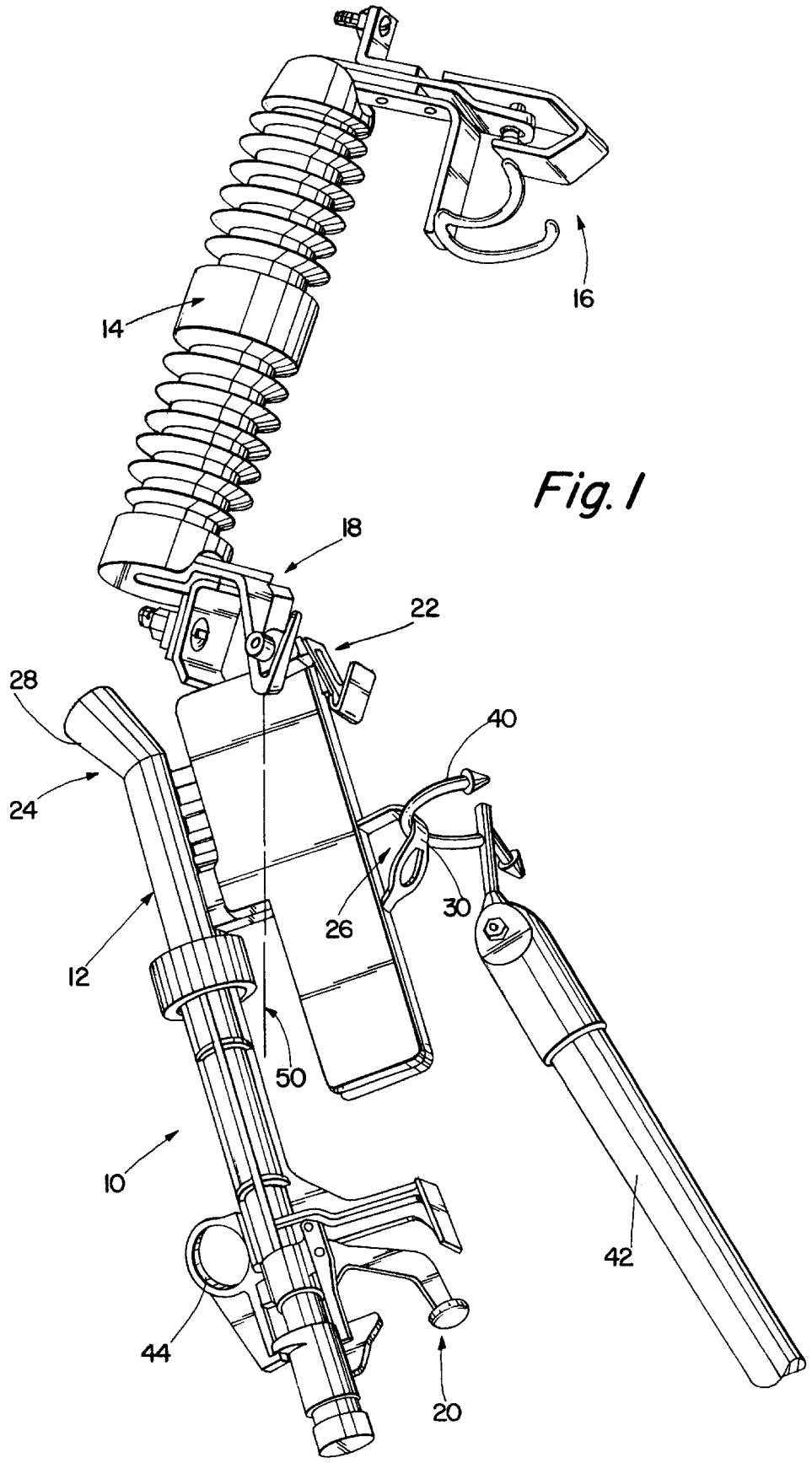
FIG. 1 is a perspective view of the circuit-interrupting device according to the present invention as shown in an open, drop-out position in a conventional cutout mounting.

Referring now to FIG. 1, the circuit-interrupting device 10 of the present invention is illustrated in a conventional cutout mounting 14. The circuit-interrupting device 10 is of the general type shown in U.S. Pat. No. 5,502,427. The mounting 14 is representative of a conventional cutout mounting, for example as illustrated in U.S. Pat. No. 4,414,527, and includes upper and lower terminal and support arrangements 16, 18 respectively. The circuit-interrupting device 10 includes a housing 12 and upper and lower contact and support arrangements 20, 22 respectively, which cooperate with the respective upper and lower terminal and support arrangements 16, 18 of the mounting 14.

The circuit-interrupting device 10 of the present invention includes exhaust diverting and directing provisions referred to generally at 24 and improved handling features referred to generally at 26. The exhaust diverting and directing provisions 24 include a nozzle portion 28 that extends from the lower end of the housing 12 and to the front of the housing 12 opposite the trailing portion of the housing 12 proximate and facing away from the mounting 14 when the circuit-interrupting device 10 is in the closed position. The nozzle 28 serves to divert exhaust away from the mounting 14 to avoid the possibilities of flashovers that might be caused by ionized gases reaching the area of the lower terminal and support arrangement 18 of the mounting 14. The handling features 26 include a handling loop 30 located on the trailing edge of the housing 12 and spaced away from the lower contact and support arrangement 20. The handling loop 30 is of the same general size and shape as that found in conventional devices and cutouts, i.e. more specifically, as shown in the aforementioned U.S. Pat. Nos. 5,502,427 and 4,414,527 and in copending application Ser. No. 08/404,686 filed in the name of H. Scherer on Mar. 15, 1995. The handling loop 30 can be molded with portions of the housing 12.

In accordance with important aspects of the present invention, the handling loop 30 facilitates insertion and removal of the circuit-interrupting device 10 with respect to the mounting 14. Specifically, when a prong 40 of a handling tool 42 is inserted into the handling loop 30 and lifted upwardly, the location of the handling loop 30 on the housing 12 initially causes pivoting of the circuit-interrupting device 10 about the lower contact and support arrangement 22 and the lower terminal and support arrangement 18 of the mounting 14. This initial pivoting from the position of FIG. 1 to the position of FIG. 2 permits the nozzle 28 to clear the lower terminal and support arrangement 18 of the mounting 14. With continued lifting of the handling tool 42 in the handling loop 30, the circuit-interrupting device 10 can be lifted out and away from the lower terminal and support arrangement 18 of the mounting 14. After removing the circuit-interrupting device 10 from the mounting 14, appropriate testing or maintenance may be performed including appropriate replacement of components.

Figure 2:
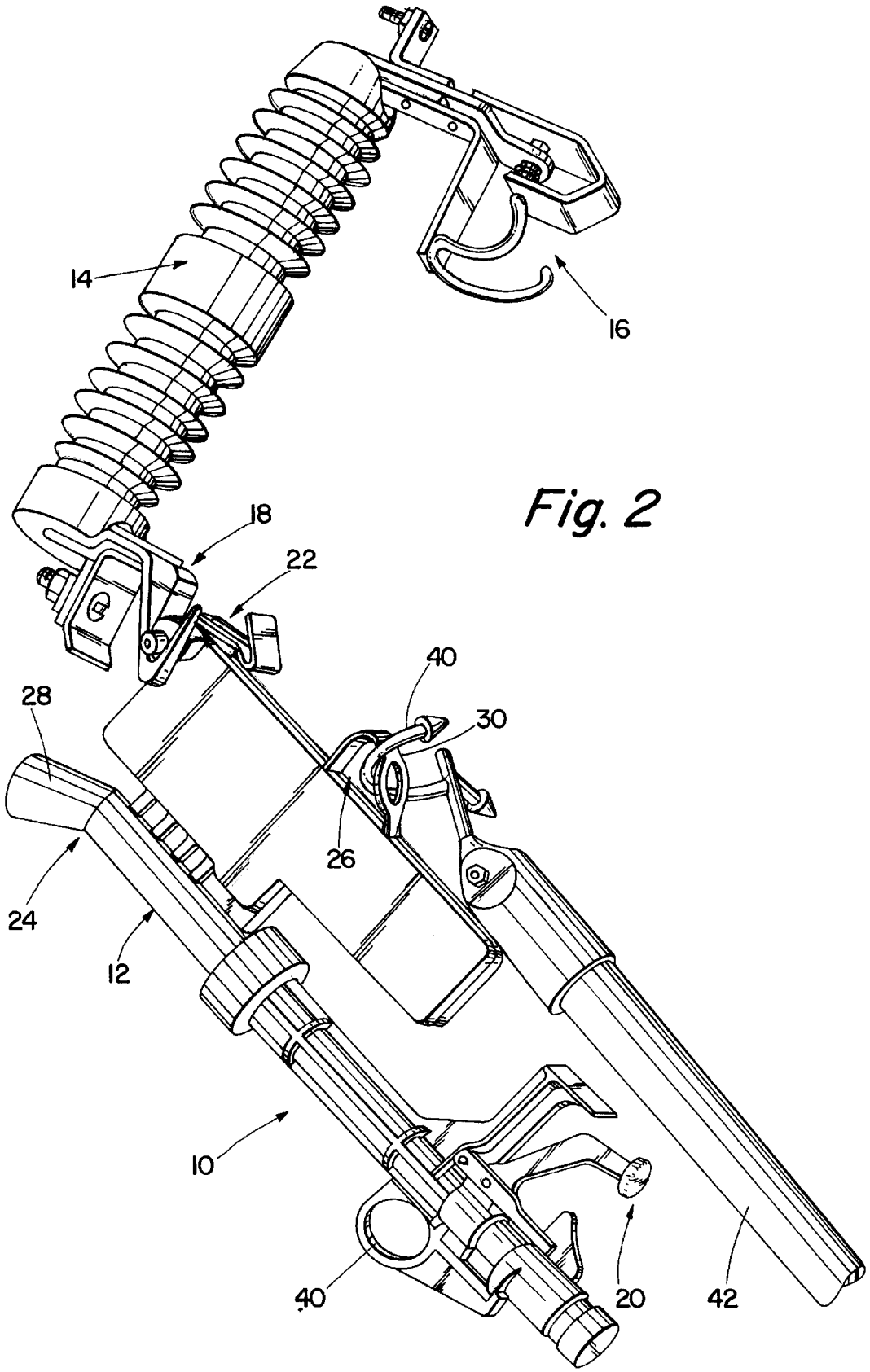
FIG. 2 is a perspective view of the circuit-interrupting device of FIG. 1 in an intermediate handling position and after manipulation by a handling tool.

Similarly, when the circuit-interrupting device 10 is inserted into the mounting 14 via lowering the lower contact and support arrangement 22 into the lower terminal and support arrangement 18, the circuit-interrupting device 10 first pivots downwardly as the handling tool 42 is lowered, from the position of FIG. 2 to the position of FIG. 1, i.e. in the position of FIG. 2, the handling tool 42 still partially supports the circuit-interrupting device 10. After the position of FIG. 1 is reached, the handling tool 42 may be used to move the circuit-interrupting device 10 upwardly to the closed position, e.g. via the pull ring 44.

The closed position of the circuit-interrupting device 10 is illustrated in FIG. 1 of the aforementioned U.S. Pat. No. 5,502,427. In that closed position, the circuit-interrupting device 10 carries electrical current and thus the closed position may be characterized as the normal operating position. The circuit-interrupting device 10 may be of type that automatically drops open and interrupts the circuit when excessive currents occur. It should also be understood that the circuit-interrupting device 10 is illustrative and that the present invention is applicable to any type of device that is to be handled with respect to a mounting, which is especially important for overhead mounted electrical transmission and distribution power systems. A suitable handling tool for the circuit-interrupting device 10 is illustrated in the aforementioned copending application serial no. 08/404,686, which also illustrates insertion and removal of a circuit-interrupting device similar to the circuit-interrupting device 10.

In accordance with important aspects of the present invention, it should be noted that the handling features of the circuit-interrupting device 10 permit removal from the mounting 14 despite the fact that the nozzle 28 initially blocks removal if the circuit-interrupting device 10 were lifted straight up and out as with removal of conventional cutouts or similar circuit-interrupting device as illustrated in the aforementioned U.S. Pat. No. 5,502,427. Specifically, the handling loop 30 is located so that sufficient pivoting of the circuit-interrupting device 10 occurs permitting the nozzle 28 to clear the mounting 14 before the circuit-interrupting device 10 is lifted out of the hinge. While a certain range of pivoting is required, i.e. such that lifting occurs at a desirable point of orientation of the circuit-interrupting device 10 to effect removal from the mounting 14, too much pivoting is undesirable, i.e. pivoting beyond a certain point results in a less desirable orientation or can block removal via interference at the top end of the mounting 14. Accordingly, the circuit-interrupting device 10 of the present invention provides a desirable combination of exhaust diverter/control features and handling features that would not be available separately. In a preferred arrangement, the handling loop 30 is located approximately ⅓ of the distance along the housing 12 toward the upper contact and support arrangement 20, i.e. a location of the handling loop 30 in the range of ¼ to ½ upward and away from the lower contact and support arrangement 22 is useful to cause pivoting of the circuit-interrupting device 10 in a direction upwardly toward the closed position. Also note that in order for the device 10 to pivot in the appropriate direction (counterclockwise in FIG. 1), the handling loop 30 should be located to the right of a line defined by the pivot point of the trunnion and the center of gravity of the device 10, i.e. in FIG. 1, to the right of a line 50.

While there has been illustrated and described a preferred embodiment of the present invention, it will be apparent that various changes and modifications will occur to those skilled in the art. Accordingly, it is intended in the appended claims to cover all such changes and modifications that fall within the true spirit and scope of the present invention.

What is claimed and desired to be secured by Letters Patent of the United States is:

1. A circuit-interrupting device for use in an electrical mounting having spaced apart upper and lower terminals and mounting arrangements, the circuit-interrupting device comprising:

a housing;

supporting means carried by said housing for supporting said housing within and for providing electrical connection to the spaced apart upper and lower terminals and mounting arrangements of the electrical mounting, said supporting means further comprising upper support means and lower support means, said lower support means comprising means for pivotally supporting said circuit-interrupting device with respect to the lower terminal and mounting arrangement of the electrical mounting; and handling means for permitting handling of said circuit-interrupting device to assist in the insertion and removal of said circuit-interrupting device with respect to said electrical mounting, said handling means comprising being located with respect to said circuit-interrupting device such that lifting of said circuit-interrupting device via said handling means initially results in pivoting of said circuit-interrupting device with respect to said lower terminal and mounting arrangement before continued lifting results in the lifting of said circuit-interrupting device out of said lower mounting arrangement.

2. The circuit-interrupting device of claim 1 further comprising exhaust diverting means extending from said housing and generally away from and below said lower support means.

3. The circuit-interrupting device of claim 2 wherein said handling means extends from said housing along a trailing edge of said housing which is defined as the edge facing and proximate the electrical mounting when said circuit-interrupting device is in an installed position in the electrical mounting.

4. The circuit-interrupting device of claim 3 wherein said exhaust diverting means extends in a direction away from said trailing edge of said housing and in a direction from a front edge of said housing opposite said trailing edge.

5. The circuit-interrupting device of claim 3 wherein said handling means is a loop.

6. A circuit-interrupting device for a mounting having spaced apart upper and lower terminals and mounting arrangements, said circuit-interrupting device comprising a housing, an upper support arrangement, a lower support arrangement at a trailing edge of said housing, and a handling feature spaced away from said lower support arrangement and fixedly located along the trailing edge of said housing.

7. The circuit-interrupting device of claim 6 wherein said handling feature is a loop extending from said housing adapted to interfit with a handling tool suitable for conventional cutouts.

8. The circuit-interrupting device of claim 6 wherein said handling feature is spaced to achieve significant pivoting of said circuit-interrupting device when said circuit-interrupting device is lifted via said handling feature.

9. The circuit-interrupting device of claim 6 wherein said handling feature is spaced in the range of ¼ to ½ of the distance between the upper and lower support arrangements.

10. A circuit-interrupting device of the drop-out type that is designed to be used in an electrical distribution cutout mounting, the electrical distribution cutout mounting being of the type including spaced apart upper and lower contact assemblies that are relatively movable upon insertion of the circuit-interrupting device into the electrical distribution cutout mounting to provide a retention force for the circuit-interrupting device, the circuit-interrupting device comprising a housing, an upper support arrangement, a lower support arrangement at a trailing edge of said housing, and a handling feature spaced away from said lower support arrangement and fixedly located along the trailing edge of said housing and arranged so as to cause pivoting of said circuit-interrupting device about the lower support arrangement when lifted by said handling feature.

* * * * *